United States Patent [19]

Gibson

[11] 3,987,544

[45] Oct. 26, 1976

[54] CHAIN SAW GUIDE BAR WITH DETACHABLE NOSE

[75] Inventor: Duane M. Gibson, Milwaukie, Oreg.

[73] Assignee: Omark Industries, Inc., Portland, Oreg.

[22] Filed: Apr. 30, 1976

[21] Appl. No.: 681,897

[52] U.S. Cl. ..... 30/384; 83/825

[51] Int. Cl.[2] ..... B27B 17/02

[58] Field of Search ..... 30/384, 385, 386, 387; 83/824, 825

[56] References Cited

UNITED STATES PATENTS

| | | | |
|---|---|---|---|
| 2,532,981 | 12/1950 | Wolfe | 30/385 |
| 2,888,964 | 6/1959 | Mall | 30/384 |
| 3,762,047 | 10/1973 | Scott-Jackson | 30/385 |
| 3,955,279 | 5/1976 | Pierson | 30/384 |

FOREIGN PATENTS OR APPLICATIONS

| | | | |
|---|---|---|---|
| 511,929 | 4/1955 | Canada | 30/385 |

*Primary Examiner*—Al Lawrence Smith
*Assistant Examiner*—J. C. Peters
*Attorney, Agent, or Firm*—Robert L. Harrington

[57] ABSTRACT

A guide bar for a chain saw including a main bar portion having its outer end edge abutting a mating inner end edge of a nose portion. At least a section of one of the bar portions adjacent the abutting end edges is formed by side plates supported in a spaced apart position by spacing posts. A connecting web connects the bar portions with the said one bar portion fitting between the spaced apart side plates. The web is provided with slots to accommodate the supporting posts and displaceable ear portions extend into the slots to resist but not prevent passage of the posts. Forcing the said one bar portion over the web causes the ear portions to deflect around the supporting posts which then resists but does not prevent separation of said one bar portion from the web.

4 Claims, 4 Drawing Figures

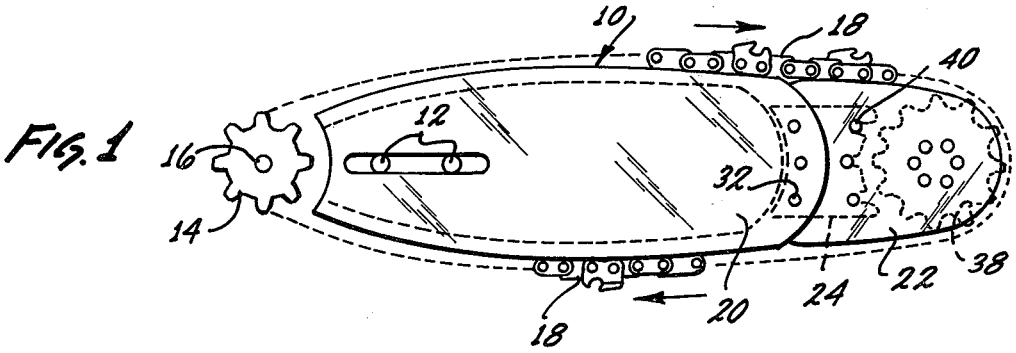
FIG. 1
FIG. 2
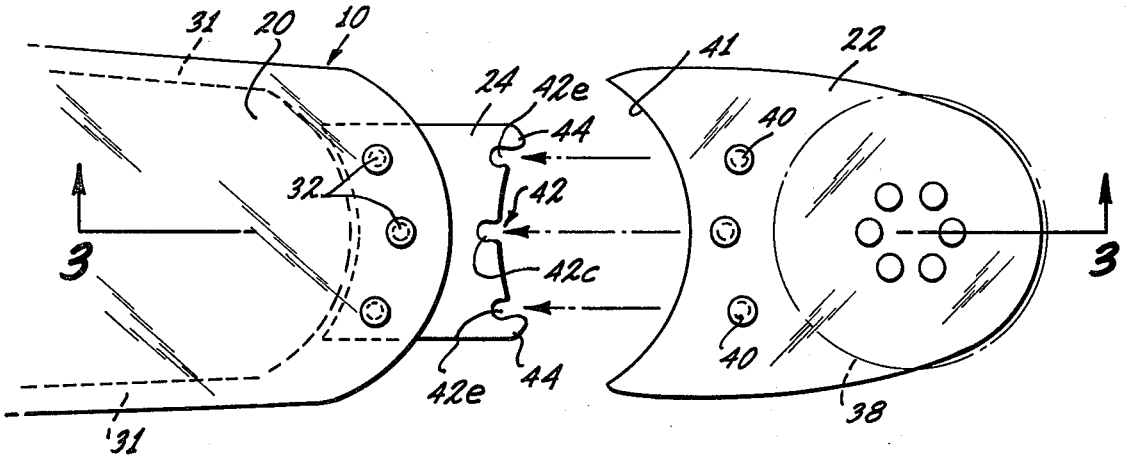
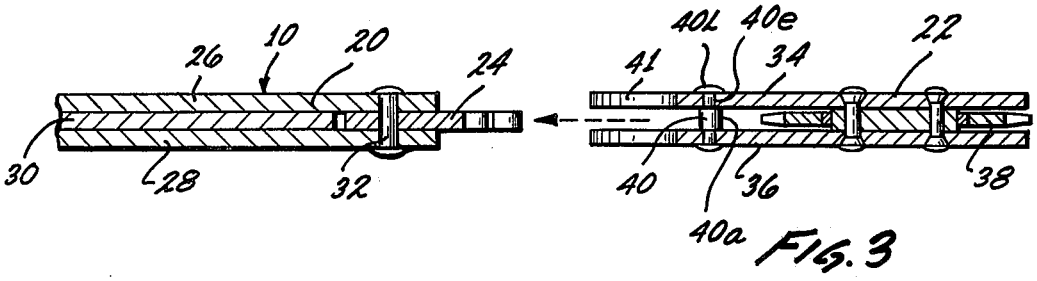
FIG. 3
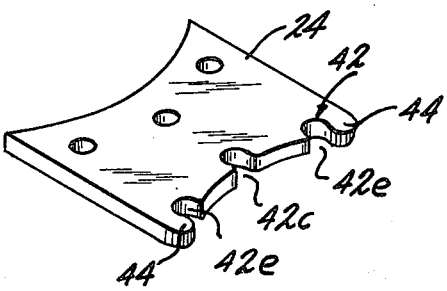
FIG. 4

CHAIN SAW GUIDE BAR WITH DETACHABLE NOSE

HISTORY OF INVENTION

This invention relates to guide bars for chain saws and more particularly to guide bars having removable nose portions.

A guide bar is an expansive component of a chain saw and because it is subjected to the friction of the driven saw chain it wears out rapidly. The nose portion of the bar is subjected to the greatest wearing and it is recognized that a guide bar having a replaceable nose portion can be equipped with several nose portions over the life of the bar and greatly increase the life of the bar. See for example, the commonly assigned patent to William F. Pierson, U.S. Ser. No. 578,461 now U.S. Pat. No. 3,955,279.

Whereas the Pierson patent teaches a structure having a replaceable nose portion, the removal and replacement of the nose portion must be done with special tools and requires considerable time and skill. The present invention teaches a structure whereby the bar portion at the abutting edges have side plates spaced by spacer posts with a snap in web segment that fits between the side plates and around the posts to interlock the web to the two bar portions. No special skills or tools are required and replacement takes mere seconds.

The invention and its advantages will become more apparent by reference to the following detailed description and drawings wherein:

FIG. 1 is a side view of a guide bar in accordance with the invention;

FIG. 2 is an enlarged partial view of the outer end of the bar showing the nose portion disconnected from the main bar portion;

FIG. 3 is a view taken on lines 3—3 of FIG. 2; and

FIG. 4 is a perspective view of the web segment of the bar.

Referring to the drawings, a guide bar 10 is adapted to be mounted to a chain saw as by mounting bolts or studs 12. A drive sprocket 14 mounted to the drive shaft 16 of the chain saw is adapted to drive a loop of saw chain 18 around the guide bar 10. The guide bar is comprised of a main bar portion 20 and a nose portion 22 interconnected by a web segment 24. Referring to FIG. 3, side plates 26 and 28 of the main bar portion are spaced apart by a core 30. The core is inset from the side edges to provide a groove 31 for the drive tangs of the saw chain. The nose portion is similarly comprised of side plates 34 and 36 spaced apart by the inner race of a nose sprocket 38 and spacer posts 40 adjacent its inner end edge 41.

As can be more clearly seen by reference to FIGS. 2 and 3, the web segment 24 is of a thickness to fit between the spaced apart side plates 26–28 and 34–36. Whereas rivets 32 fasten the web to the main bar portion, slots 42 are provided to accommodate the spacer posts 40 with ear portions 44 restricting the slot opening to resist, but not prevent removal. As the chain is driven around the bar, the acting forces hold the nose and main portion of the bar together. Thus the gripping power of the ear portion 44 need not be great and, to the contrary, should be quite easily deflected to provide for easy assembly and disassembly with tools such as normally carried by a logger. For example, the posts 40 are common saw chain rivets having a center section 40*a* that is .063 inches in length and .188 inches in diameter. The reduced end portions 40*e* have a diameter of .121 inches and are provided with rivet heads 40L. The web segment 24 is made of 6150 steel with a thickness of .063 inches. The center slot 42*c* has a width of .196 inches. The end slots 42*e* have a similar inside width while ear portions 44 partially close entrance to the slots 42*e* by projecting .018 inches into the slots.

Whereas numerous variations will be apparent to those skilled in the art, the invention is not limited to the above described embodiment. For example, although the slots and corresponding spacer posts are important for alignment, it is conceived that the gripping action of the ear portions 44 may be replaced by a detent in one or the other of the web and bar/nose portion, with an embossment on the mating part to fit the detent and resist removal. The use of a detent is disclosed for example in prior U.S. Pat. No. 2,888,964. Thus the invention is to encompass the definition provided in the accompanying claims.

I claim:

1. A guide bar for a chain saw having a replaceable nose portion comprising a main bar portion, a nose portion, and a web interconnecting the main bar portion and the nose portion, said main bar portion and nose portion having abutting edge and one of the portions including spaced apart side plates and at least one post spanning between the side plates, said web fitting between said side plates and having a slot adapted to accommodate the post and gripping means on at least one of the web and said one portion that provides resistive insertion of the post into the slot for quick connecting and disconnecting of the nose portion to the main bar portion.

2. A guide bar for a chain saw as defined in claim 1 wherein the web has a deflectable ear portion partially closing the slot as the gripping means.

3. A guide bar for a chain saw as defined in claim 2 wherein both the main bar portion and nose portion have spaced apart side plates and a post spanning the side plates and the web segment having accommodating slots and ear portions for engaging and disengaging the web.

4. A guide bar for a chain saw as defined in claim 3 wherein the posts are spacer posts for spacing the side plates to accommodate the web.

* * * * *